United States Patent [19]

Mitchell et al.

[11] Patent Number: 4,858,758

[45] Date of Patent: Aug. 22, 1989

[54] OXIDANT BLEACH, CONTAINER AND FRAGRANCING MEANS THEREFOR

[75] Inventors: Frances E. Mitchell; G. Edward Campbell, both of Pleasanton; Dale S. Steichen, Livermore, all of Calif.

[73] Assignee: The Clorox Company, Oakland, Calif.

[21] Appl. No.: 284,783

[22] Filed: Dec. 12, 1988

Related U.S. Application Data

[63] Continuation of Ser. No. 893,524, Aug. 4, 1986, abandoned.

[51] Int. Cl.[4] ..... B65D 81/24; B65D 51/16; B65D 23/00; C01B 15/00

[52] U.S. Cl. ..... 206/205; 215/1 C; 215/228; 215/307; 220/23; 512/1; 252/90; 252/174.11; 252/186.42; 206/524.6

[58] Field of Search ..... 220/23, 87, 336; 215/307; 252/186.42, 90, 94, 95, 174.11; 206/524.1, 524.5, 524.6; 512/1

[56] References Cited

U.S. PATENT DOCUMENTS

| | | | |
|---|---|---|---|
| D. 247,347 | 2/1978 | Klingaman | D9/40 |
| 2,362,796 | 11/1944 | Boesel | 312/31.1 |
| 2,915,404 | 12/1959 | Tessmer et al. | 99/171 |
| 2,965,257 | 12/1960 | Lipman | 215/56 |
| 3,061,549 | 10/1962 | Dickey | 252/90 |
| 3,071,276 | 1/1963 | Pellett et al. | 215/56 |
| 3,181,720 | 5/1965 | Cassie et al. | 215/56 |
| 3,409,160 | 11/1968 | Scott | 215/56 |
| 3,448,882 | 6/1969 | Roy | 215/56 |
| 3,595,419 | 7/1971 | Dukess | 215/40 |
| 3,819,460 | 6/1974 | Dukess | 161/42 |
| 3,856,172 | 12/1974 | Walles | 215/364 |
| 3,951,293 | 4/1976 | Schulz | 215/261 |
| 4,007,848 | 2/1976 | Snyder | 215/31 |
| 4,089,434 | 5/1978 | Taligakis et al. | 215/260 |
| 4,121,728 | 10/1978 | Taligakis et al. | 215/260 |
| 4,259,201 | 3/1981 | Cockrell, Jr. et al. | 252/103 |
| 4,269,722 | 5/1981 | Joshi et al. | 252/90 |
| 4,337,339 | 6/1982 | Farina et al. | 544/257 |
| 4,339,356 | 7/1982 | Whyte | 252/522 A |
| 4,351,740 | 9/1982 | Joshi et al. | 252/90 |
| 4,392,055 | 7/1983 | Whitney | 215/307 |
| 4,444,673 | 4/1984 | Joshi et al. | 252/90 |
| 4,475,663 | 10/1984 | Kittscher et al. | 220/87 |
| 4,512,498 | 4/1985 | Leibinger | 220/371 |
| 4,533,062 | 8/1985 | Krautkrämer | 220/258 |
| 4,540,721 | 9/1985 | Staller | 523/102 |
| 4,636,328 | 1/1987 | Flynn et al. | 220/23 |

FOREIGN PATENT DOCUMENTS

| | | |
|---|---|---|
| 4463 | 10/1979 | European Pat. Off. . |
| 2156870 | 10/1985 | United Kingdom . |

OTHER PUBLICATIONS

U. Reischl et al., "Comparative Assessment of Goretex TM and Neoprene TM Vapor Barriers in a Firefighter Turn-Out Coat", *Textile Research Journal,* pp. 643–647, Nov. 1980.

B. Keating, "Uncle Sam's Workshop", *Science 81,* pp. 37–43, Apr. 1981.

Seymour, *Introduction to Polymer Chemistry,* pp. 362–363 (1971).

Titow, *PVC Technology,* p. 37.

(List continued on next page.)

*Primary Examiner*—John S. Maples

*Attorney, Agent, or Firm*—Joel J. Hayashida; Stephen M. Westbrook; Michael J. Mazza

[57] ABSTRACT

A transparent, durable container for housing and delivering a free-flowing granular dry oxidant bleach composition, the container being constructed of a heteropolymeric plastic which maximizes transmission of water vapor for minimum decomposition of the oxidant bleach stored within the container. The selected plastic has a water vapor transmission rate of at least about 2 g/day/100 in.$^2$/mil. thickness. The container may include a fragrancing means located remote from the container. The fragrancing means is isolated from the bleach composition by an apertured barrier which allows the fragrance to contact the bleach composition but does not allow the bleach composition to contact the fragrancing means.

30 Claims, 4 Drawing Sheets

OTHER PUBLICATIONS

Oswin, *Plastic Films and Packaging,* pp. 37, 69 109 & 114.

Phillips Chemical Company, *K-Resin® Polymers* Technical Service Memorandum, Feb. 1985.

March, *Advanced Organic Chemistry,* 2nd ed., pp. 17-22, (1977).

Noller, *Chemistry of Organic Compounds,* pp. 113-123, 1951.

K-Resin Polymers—Phillips Chemical Company Publications Nos. 200 (Properties & Processing) and 203 (Blow Molding).

European Search Report on EP 87.306554 (equiv. of parent application Ser. No. 06/893,524), Jan. 12, 1989.

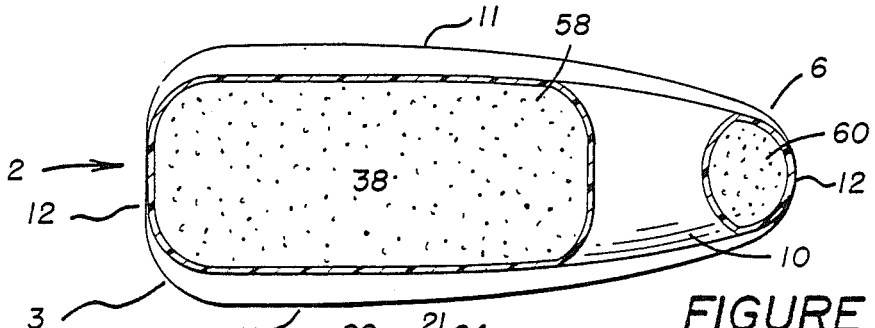
FIGURE 9
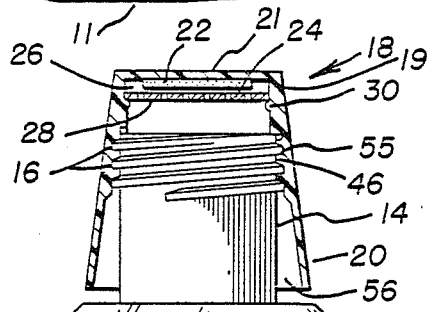
FIGURE 1
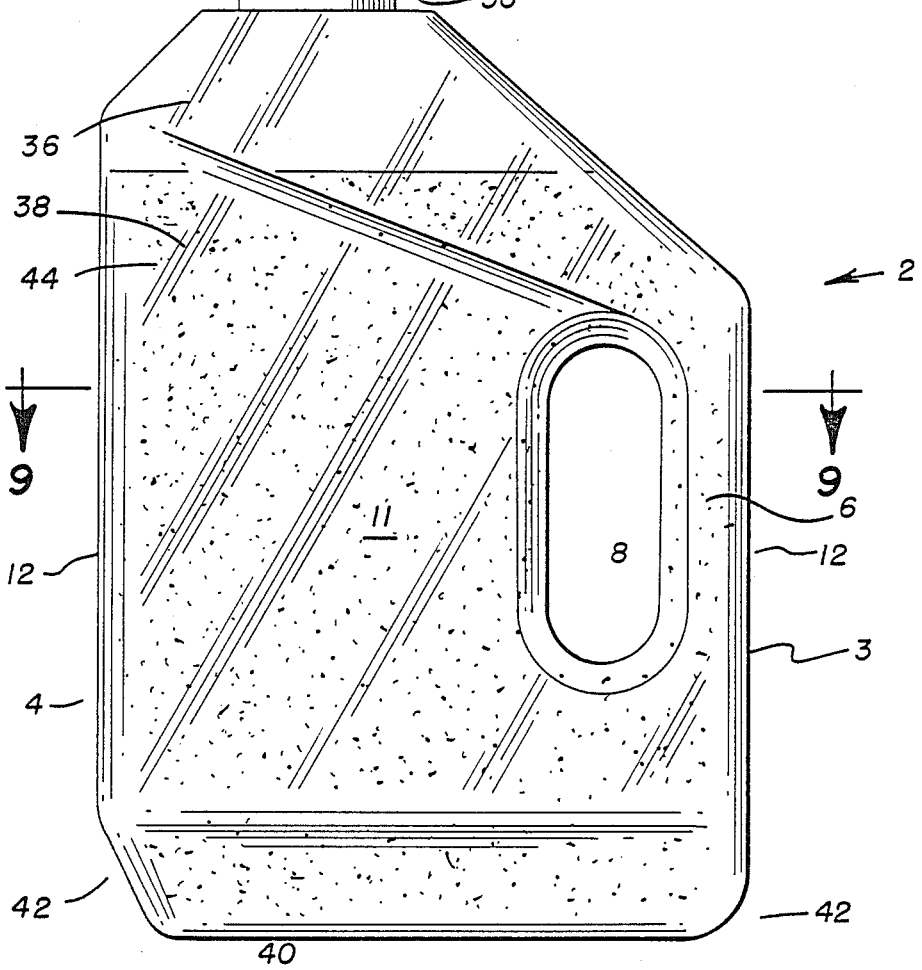

FIGURE 4
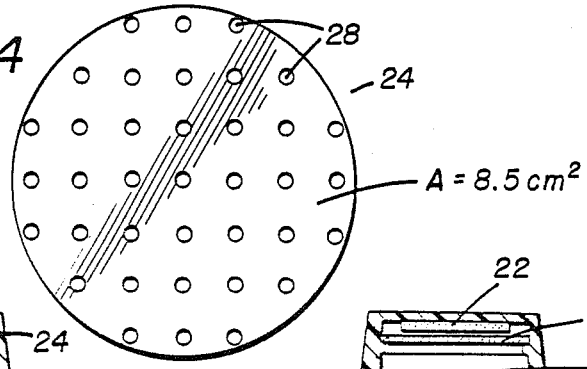
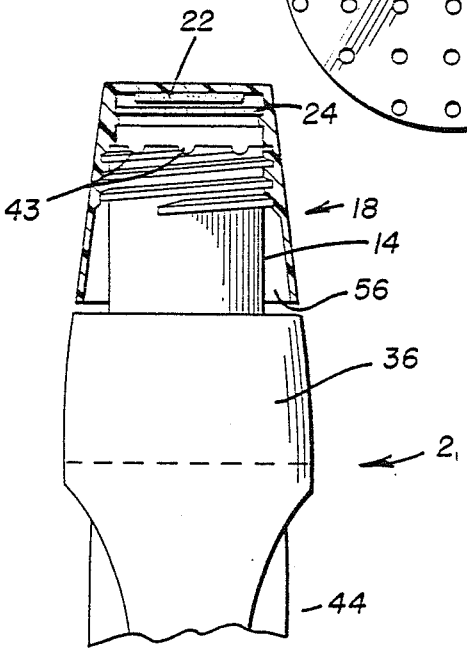
FIGURE 5
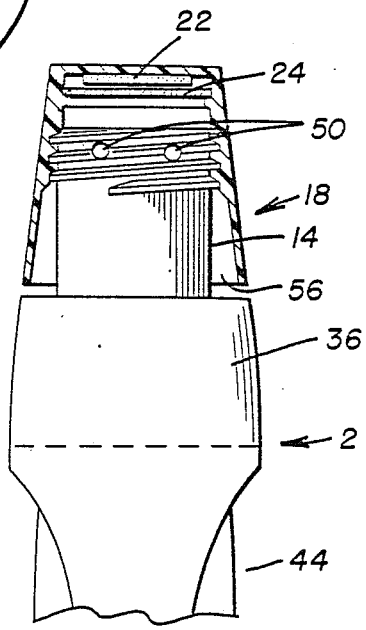
FIGURE 6
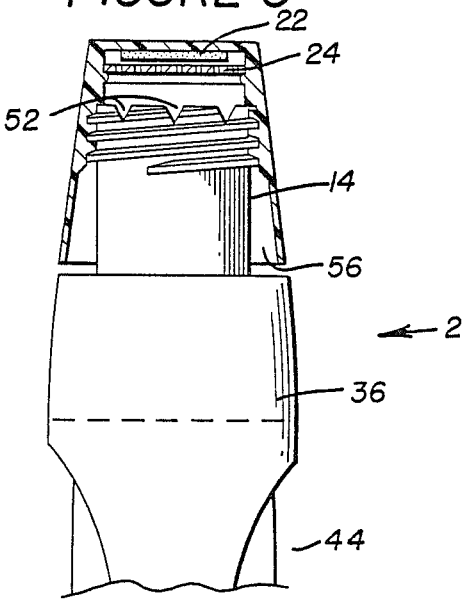
FIGURE 7
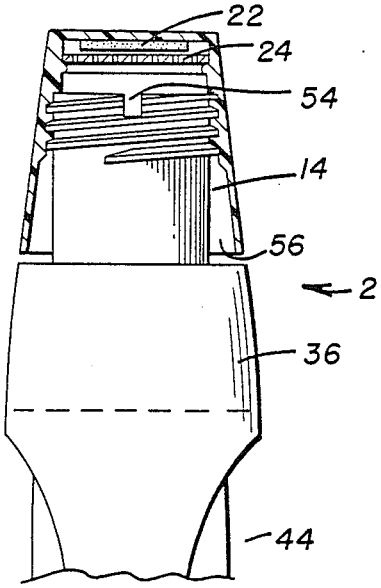
FIGURE 8

AO STABILITY IN DIFFERENT RESINS

OXIDANT BLEACH, CONTAINER AND FRAGRANCING MEANS THEREFOR

This is a continuation of application Ser. No. 06/893,524, filed Aug. 4, 1986, now abandoned.

BACKGROUND OF THE INVENTION

1. Field of the Invention

The invention relates to plastic containers for oxidant bleaches. The container is carefully constructed to avoid or minimize interaction between the container material and an oxidant bleach, a fragrance, or both, contained therein, to prevent formation of malodors and to minimize decomposition of the oxidant bleach composition.

2. Brief Description of the Prior Art

Containers for delivering dry detergents constructed of both plastics and cardboard have been disclosed in the prior art. For example, Joshi et al, U.S. Pat. Nos. 4,444,673, 4,351,740 and 4,269,722, disclose a clear bottle, with a hollow handle, for dispensing dry detergents. However, the material used to construct such containers for detergent is not critical.

Other prior art discloses containers provided with venting means to alleviate pressure, of gases evolved by materials disposed within the container, e.g., Snyder, U.S. Pat. No. 4,007,848, or Whitney, U.S. Pat. No. 4,392,005. Still other references disclose fragrancing containers, for instance, Kittscher et al, U.S. Pat. No. 4,475,663, shows a pail having a perfumed disc which also acts as a gasket for a carrying handle, and E.P. No. 4463, shows a carton impregnated with perfume to fragrance the head space of the carton.

However, none of the prior art discloses, teaches or suggests that a plastic container which is used to house an oxidant bleach must be constructed of a material that avoids decomposition of the bleach and/or the formation of malodors via interaction of the bleach with the plastic container material. Further, nothing in the art discloses, teaches or suggests that when a fragrance disposed within a plastic container housing an oxidant bleach for fragrancing the bleach, or the headspace thereof, there may be interaction between the fragrance and the container, resulting in additional malodor formation. Thus, a conventional fragrancing means used in such an environment may not only be ineffective to solve the problem it was originally intended to solve, but in fact it may exacerbate the problem. The prior art has failed to recognize such problems, or to provide or suggest any means of solving such problems, and the teachings of the prior art, such as that outlined above, are not instructive with respect to the problems solved by the present invention.

SUMMARY OF THE INVENTION

The invention provides a container for housing and delivering a free-flowing granular dry oxidant bleach composition. The container is constructed of a special heteropolymeric plastic which maximizes transmission of water vapor through the wall of the container from an oxidant bleach stored within the container thus minimizing decomposition of the bleach.

The container includes fragrancing means located remote from said bleach composition to fragrance the unfilled portion of the container, said fragrancing means being isolated from said bleach composition by a barrier means which allows the fragrance to contact the bleach composition but does not allow the bleach composition to contact the fragrancing means.

The heteropolymeric plastic is further selected to prevent interaction with a fragrancing means which is located within the container at a location remote from the oxidant bleach.

The container includes a venting means to reduce the concentration of malodors from the oxidant bleach.

The container includes a closure having a recessed portion containing suitable amount f fragrance combined with an amorphous polymer.

BRIEF DESCRIPTION OF THE DRAWINGS

FIG. 1 depicts a front elevational view of a container embodying the present invention, including a closure shown in section;

FIG. 4 shows the barrier means of the present invention.

FIG. 5 shows one embodiment of a venting means of the container;

FIG. 6 shows yet another embodiment of the venting means of the invention;

FIG. 7 shows yet still another embodiment of the venting means of the invention; and FIG. 8 shows a further embodiment of the venting means of the invention.

FIG. 9 shows a sectional view of the container of FIG. 1, taken along lines 9—9 thereof.

DETAILED DESCRIPTION OF THE PREFERRED EMBODIMENT

Figure 2:
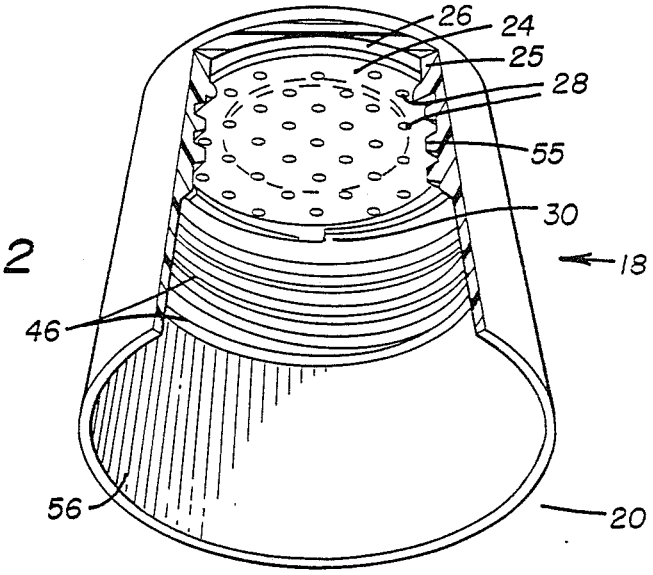
FIG. 2 shows the closure of the container of FIG. 1, partially in section.

Peracid-based bleaches, include a number of effective dry bleach formulations which have excellent soil and stain removal properties. Peracid bleaches work much in the manner of other oxidant bleaches, such as sodium hypochlorite and sodium perborate, by oxidizing soil on fabrics. Preferred examples of these sorts of peracid bleaches are the diperacids disclosed in Marynowski et al, U.S. Pat. No. 4,337,339; and U.S. patent application Ser. Nos. 767,980 (filed Aug. 21, 1985) and 792,344 (filed Oct. 28, 1985) and assigned commonly to The Clorox Company, all of which are incorporated herein by reference.

However, packaging of peracid bleaches has proven to be problematic. Because of their great ability to oxidize, peracid bleaches can actually decompose themselves as well as numerous other substances. Further, such peracid bleaches will contain residual amounts of moisture, and if the moisture becomes concentrated, rapid second order decomposition can occur which results in the decomposition of the peracid bleach.

Also, these peracid bleaches, such as the long chain diperacid known as diperoxydodecanedioic acid ("DPDDA"), contain long chain acids and diacids which typically are quite malodorous. Therefore, some means of suppressing such malodors in consumer products is desirable. The typical solution to reducing such malodors in such consumer products is to include a fragrance in the composition. However, applying a fragrance directly to an organic diperacid is unsatisfactory because the fragrance will itself be decomposed by the diperacid, possibly leading to a worse malodor.

Therefore, such conventional fragrancing techniques not only fail to solve the problem but actually increases the problem.

1. The Container Material

In order to present a novel and attractive container to the consumer, it is desirable to incorporate this dry bleach product in a transparent container. Transparent containers represent attractive and cost effective ways of packaging and marketing dry peracid bleaches. As mentioned, clear containers have been used to house dry, granular detergents but not dry granular oxidant bleaches. However, it has now been discovered that use of certain plastic resins to construct containers for peracid bleaches will accelerate the decomposition of such bleaches due to their failure to transmit moisture released from the peracid bleach composition.

The use of prior art clear plastic materials to house oxidant bleaches is a problem because such plastic materials are generally more water impermeable than cartons and thus residual or developed moisture present in the bleach composition will not evaporate. The presence of this residual moisture may lead to decomposition of the oxidant bleach or may expedite other oxidative reactions.

Surprisingly, it has also been discovered that the use of certain heteropolymeric plastics as the material for construction of the container of the invention provides a sufficient rate of moisture transmission to avoid such decomposition.

Applicants have discovered that certain hydrocarbon polymers, such as, polyethylene and polypropylene, which are, low cost plastic materials, typically used in a variety of bottle applications, will actually increase the instability of peracid bleach compositions contained in a container constructed thereof; but that the use of heteropolymeric plastics avoids the decomposition of the bleach which arises from their ability to release residual or developed moisture in the bleach formula. Furthermore, it has also been surprisingly discovered that certain of such heteropolymeric plastics also avoids an interaction with fragrances that react with some plastics to form malodors.

It is not entirely understood why heteropolymeric plastics are necessary to construct dispensers which avoid such decomposition problems Applicants theorize that, the phenomenon of increased product decomposition corresponds to the water vapor transmission properties of the plastic materials which is related to the polarizability of the substituents of the plastic.

The term heteropolymeric plastic as used in the present invention comprises polymers which include polymers containing monomer units which have at least one heteroatom such as N, O, F, and in certain cases other halogen atoms and also copolymers which contain styrene monomer units; and which have water vapor transmission rates of about 2 g/day/100 in$^2$/ml thickness or greater. The most preferred plastics are those selected from the group consisting essentially of butadiene/styrene copolymers, polyvinyl chloride, acrylonitrile, polyethylene terephthlate glycol, and mixtures thereof. It has been found that, if necessary, some amount of conventional plastics can be incorporated with any of the above heteropolymeric plastics to increase strength, clarity, to lower materials cost, etc., so long as the above criterion is satisfied.

A particularly preferred plastic is a styrene butadiene copolymer, commercially available from Phillips Chemical Company under the trademark "K-resin." K-resin polymers have excellent visual clarity and a light transmission value of at least 90–91%. These polymers have high strength and durability (elastic modulus of about 191,000 psi as measured under ASTM method D790, or 1,316 MPa). These polymers can be injected, injection molded, blow molded or thermoformed, as desired. These butadiene/styrene copolymers can be blended with other resins to lend different properties as described above. Other resins which can be blended with butadiene styrene copolymers include general purpose polystyrene, high impact polystyrene, styrene-acrylonitrile, styrene methylmethacrylate and polypropylene, so long as the above criterion is satisfied.

Acrylonitrile is another material which is preferred for use in constructing the dispenser of the invention. Acrylonitrile is generally prepared by the reaction of acetylene and hydrogen cyanide in the presence of a catalyst under relatively high temperatures, among other methods (See Seymour, *Introduction to Polymer Chemistry* (1971), pages 362–363.) Acrylonitriles have good stability and durabililty.

Another suitable heteropolymer is polyethylene terephthalate glycol. This heteropolymer can be produced by reacting glycol with terephthalic acid in the presence of a catalyst. The resulting plastic is very durable and has good clarity. (See e.g., Oswin, *Plastic Films and Packaging,* page 109).

Polyvinyl chloride also provides the moisture transmission characteristics desirable for the present invention. However, presently available commercial polyvinyl chlorides appear to suffer from one significant drawback with respect to certain contemplated applications since they react with certain fragrances to produce malodors. However, they are an acceptable plastic in the absence of a fragrancing means.

Suitable methods of forming and manufacturing the containers of the invention are disclosed in Kirk-Othmer, Encyclopedia of Chemical Technology, 3rd Ed., Vol. 18, pages 184–206 (1982), the disclosure of which is incorporated herein by reference.

It is particularly preferred that the bottle of this invention be blow molded. This is usually accomplished by, generally, providing a mold into which is introduced molten resin in the form of a parison. After the air is fed into the die, the parison expands to fill the mold and then is cooled to form the bottle. Thereafter, the bottle is removed from the mold. Thermoforming presents another excellent method for making the bottles of the invention.

2. The Closure

The inventive containers require closures for obvious reasons. The closures of the present invention are internally threaded and have a depending skirt portion wider than the upper portion of the closure. The closure may be constructed of plastics which are generally different than the plastic used for the bottle portion of the container since it does not experience extended contact with the peracid bleach. However, polyvinyl chloride should be avoided due to the fragrance reaction problems discussed above.

The closure comprises an end wall or panel, and an annular wall depending therefrom, which includes an upper, internally threaded portion, and a lower skirt portion. An annular finish abutment rim is provided at the upper limit of the threads and is spaced from the end panel.

The closure of the invention is provided with a relatively deep well defined by the internal portion of the closure from the end panel to just below the last top turn of the internal threads. This well may range in volume from 0.25 to 10 $cm^3$, although this is not critical. The well is provided to house a self-adhering fragrancing means, discussed below. By having a defined volume, it is most convenient to apply or insert the fragrancing means directly into the well in a premeasured amount.

In order to protect the fragrancing means from contact with the oxidant bleach, both when the closure is used as a measuring cup and if the fragrancing means were to accidentally jar loose from the closure during storage, a barrier means is provided, as detailed below. The barrier means typically is a perforated disc and can function in the manner of a liner for the closure. The closure also contains venting means, as disclosed in greater detail below.

3. Fragrancing Means

In order to overcome the problem of malodors emanating from the preferred long cain diperacids housed in the inventive container, a fragrancing means is provided to fragrance and permeate the head space, or unfilled portion, of the container. The fragrancing means is preferably located in an area remote from where the oxidant bleach composition is located.

In a preferred embodiment, as disclosed in pending U.S. application Ser. No. 767,980, filed Aug. 21, 1985 (commonly assigned to The Clorox Company), a small strip of fragranced material is affixed to an area remote from the oxidant bleach. In the present container this is accomplished by placing the fragranced material in the closure well.

The fragranced material generally comprises an amorphous hydrophobic, self-adhering polymeric material into which a fragrance has been intimately dispersed. The fragrance is usually a proprietary material which is commercially available from manufactures such as International Flavors and Fragrances, Givaudon and Firmenich, Inc. Further potential examples of appropriate fragrances may be disclosed in Whyte, U.S. Pat. No. 4,339,356, Staller, U.S. Pat. No. 4,540,721, published European application EP No. 147191, and Hooper et al, U.S. Pat. Nos. 4,579,677 and 4,347,153, the disclosures of which are incorporated herein by reference.

The polymer matrix material used to encompass the fragrance is selected from water-miscible, water-dispersible and hydrophobic polymers. However, as described, it is preferably a hydrophobic, amorphous polymer which can be melted and the fragrance oil can be admixed therewith. Suitable materials include ethylene/ethylacrylate blends, polyethylene/polypropylene blends, polyamides, polyesters and ethyl/vinyl acetate co-polymers. It is particularly preferred to use an ethyl/vinyl acetate co-polymer due to its self-adhering properties when solidified at room temperature, and because of its ability to contain relatively large volumes of fragrancing material. A typical hot melt fragrance composition may contain from about 10–60 wt.% of the fragrance oil and about 10–75% vinyl acetate in the ethylene/vinyl acetate co-polymer. Such fragrance/adhesive mixtures should have an equivalent hot melt index of from 1–50,000; and a hot melt ring and bowl softening point of from 150°–300° F. About 0.25–10 grams of the fragranced adhesive are applied to the well area of the closure described above.

The head space, or unfilled portion, of the not critical and is dependent upon the amount of oxidant bleach which is in the container compared with the total volume of the container. Of course, this space will increase as bleach material is used from the container,

3. Barrier Means

In order to protect the fragrancing means from contact with the oxidant bleach, and to contain the fragrancing means within the closure, a barrier means is provided in the closure adjacent the fragrancing means. The barrier means comprises an apertured disc, although other designs are feasible, e.g., cross-hatched reticular, etc. The preferred barrier means of the invention comprises a disc made of polyethylene having a series of apertures provided therein. Although the size of the apertures is not critical, it is preferred that the average bore size of the apertures be smaller than the average particle size of the oxidant bleach composition. Therefore, the apertures will typically have an average bore size of about 0.25 mm to about 4 mm. The number of apertures contained within the disc is also not critical. However, the number of apertures per unit area is preferably in the range of about 0.3 apertures/$cm^2$ to about 16 apertures/$cm^2$.

4. Venting Means

It is also advantageous to provide venting means in the container of the invention to allow gaseous exchange between the interior of the container and the surrounding atmosphere. In this manner, concentration of malodors, such as those arising from the preferred long chain diperacids, is avoided.

The venting means comprises a channel from the interior of the bottle finish to the atmosphere through defined space provided between bottle finish and closure threads. The venting means includes passage means for communicating the interior of the bottle finish with the threads. In one embodiment this comprises ramps or raised portions on the lower surface of an abutment rim adjacent the upper limit of the threads of the closure which prevent complete sealing of the container finish with the closure when the closure is rotationally closed down on the neck portion. As will be described in greater detail below, the passage means provides for a beneficial venting of gases within the container to the surrounding atmosphere.

In further preferred embodiments of the venting means, selected slots or apertures can be provided in the neck portion of the container to communicate gases between the bottle finish interior and the space between the finish and cap threads. These are further disclosed in greater detail below.

5. Oxidant Bleach Composition

The preferred oxidant bleach composition of the invention comprises a dry granular bleach composition including organic peracid granules, diluents, pH control agents, and exotherm control agents. A typical organic diperacid has the structure $$HOOC-\overset{\overset{\displaystyle O}{\|}}{C}-R-\overset{\overset{\displaystyle O}{\|}}{C}-COOH$$

wherein R is a linear alkyl chain of about 6 to 12 carbon atoms in the chain.

Particularly preferred for use is diperoxydodecanedioic acid (DPDDA). This particular type of diperacid is relatively stable and has excellent stain and soil removal performance. In order to prevent exothermic decomposition, an exotherm control, such as magnesium sulfate is generally added. The ratio of magnesium sulfate to DPDDA is generally in the range of about 0.15:1 to 0.9:1, most preferably 0.35:1 to 0.75:1 on a weight basis.

It is also preferred that the amount of water present as water of hydration of the magnesium sulfate be about 50–70% by weight of the magnesium sulfate when the diperacid granule contains a molar equivalent or excess of sodium sulfate to magnesium sulfate. This level of water corresponds roughly to about magnesium sulfate with 4 molecules of water of hydration. However, in the oxidant bleach granule, this most likely exists as a double salt of magnesium sulfate and sodium sulfate. Other components are present in the diperacid composition to act as bulking agents or diluents, such as sodium sulfate. Other materials can be present in the diperacid composition, such as adipic acid (pH control agent), polyacrylic acid (binder), fluorescent whitening agents, enzymes, bluing agents, ad the like known to those skilled in the art.

Best Mode of the Invention

Referring to the drawings, FIGS. 1 and 9 (which is a sectional view of the container in FIG. 1, taken along lines 9—9 thereof) depict a container, shown generally at 2, which container discloses a best mode of the invention. The container bottle is constructed of a butadiene/styrene copolymer and its closure is constructed of polyethylene.

Bottle 3 has a body portion 4 which includes a hollow handle 6 defined by an elongated aperture 8 in the body portion 4. The interior of the handle is in communication with the rest of the body interior. The bottle 3 also has a neck or finish 14, joined to the body, which is externally threaded with helical threads 16.

The bottle body comprises a reinforced base plate 40, upstanding side walls 11, and end walls 12 joining the side walls in spaced relationship; and reinforced areas 42 connecting the base plate with the side walls and end walls. Recessed areas 44 may be provided on the side walls for placement of appropriate labels.

The dispenser also includes a closure 18, having an upper portion, 19, closed by an end wall or panel, and provided with internal helical threads, 46, spaced from such end wall. The threads 16 and 46 are complementary and cooperate when the cap closure 18 is rotationally closed down on the finish 14. The closure also includes a depending skirt 20 connected to and depending from the upper portion 19. The closure 18 is preferably provided with appropriate measuring lines (not shown), as it is intended to act also as a measuring cup for use in measuring and dispensing appropriate amounts of oxidant bleach.

Figure 3:
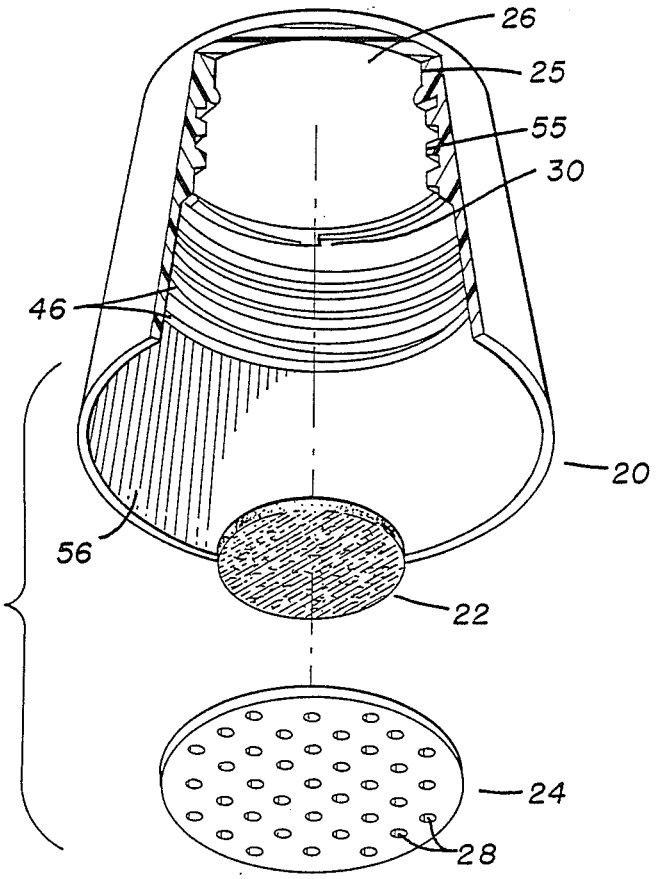
FIG. 3 shows an exploded view of the closure of FIG. 2.

Turning now to FIGS. 2 and 3, the closure includes an annular rim 25 provided on its interior surface and spaced from the end panel. The space between the end panel and the rim defines a well 26 provided for disposition of a fragrancing means therein. The well 26 (which has been somewhat exaggerated for emphasis) has a sufficient volume such that a fragrancing means 22 having a premeasured amount of a fragrance entrapped within a polymeric matrix can be easily filled or injected into the well 26.

To protect the fragrancing means 22 from the oxidant bleach granules when the closure is used as a measuring cap, as well as to isolate the fragrancing means 22 from the bleach granules contained within the container during storage, a barrier means 24, is provided in the cap adjacent the fragrancing means. The barrier means, preferably comprises an apertured disc, having a series of apertures28. This barrier means also serves to prevent the fragrancing means from coming into intimate contact with the oxidant bleach 38 in the interior of bottle 3 (see FIG. 1), if the fragrancing means should dislodge or detach from the well of the cap closure 18 due to a sharp blow.

In order to permit venting of gases within the container, threads 46 and 16 are arranged to provide a gas passage 55 there between. In addition, the annular skirt 20 is broader than the corresponding portion of the container which provides an annular channel 56 there between. Furthermore, annular rim 25 has a stepped or ramped lower surface 31 which prevents the rim of finish 14, and thus bottle 3 from being completely sealed by the cap closure 18, and allows gas communication from the interior of the container, through passageways 55 and 56, to the atmosphere.

Other embodiments of the venting means of the dispenser are shown in FIGS. 5 through 8. In each of these embodiments, the neck 14 is provided with apertures, notches or the like to allow venting of from the container to the channel defined by the finish and closure threads. In FIG. 5, semicircular notches 48 are provided in neck 14; in FIG. 6, apertures 50 are provided in the neck 14; in FIG. 7, V-shaped notches 52 are provided in the neck 14; and in FIG. 8, a square cut notch 54 is provided in the neck 14.

Although unshown, the closure 18 can be further internally stabilized by the provision of wings or other axial stabilizers inside of the skirt 20.

EXPERIMENTAL

In Example I below, the stability of DPDDA bleach compositions in bottles composed of various plastic materials is compared. As will be shown in such Examples, surprisingly improved stability of such oxidant formulations is demonstrated by the inventive containers.

EXAMPLE I

In 4 oz. bottles without the fragrancing means, made of plastics described below, a DPDDA bleach composition was formulated as follows:

| Ingredient | wt. % |
|---|---|
| DPDDA product (20% active) | 15.86 |
| Buffer | 18.20 |
| Brightener granules | 3.00 |
| Enzyme | 1.47 |
| Misc. | 0.79 |
| Agglom. $Na_2SO_4$ | 60.68 |
| | 100.00 |

Figure 10:
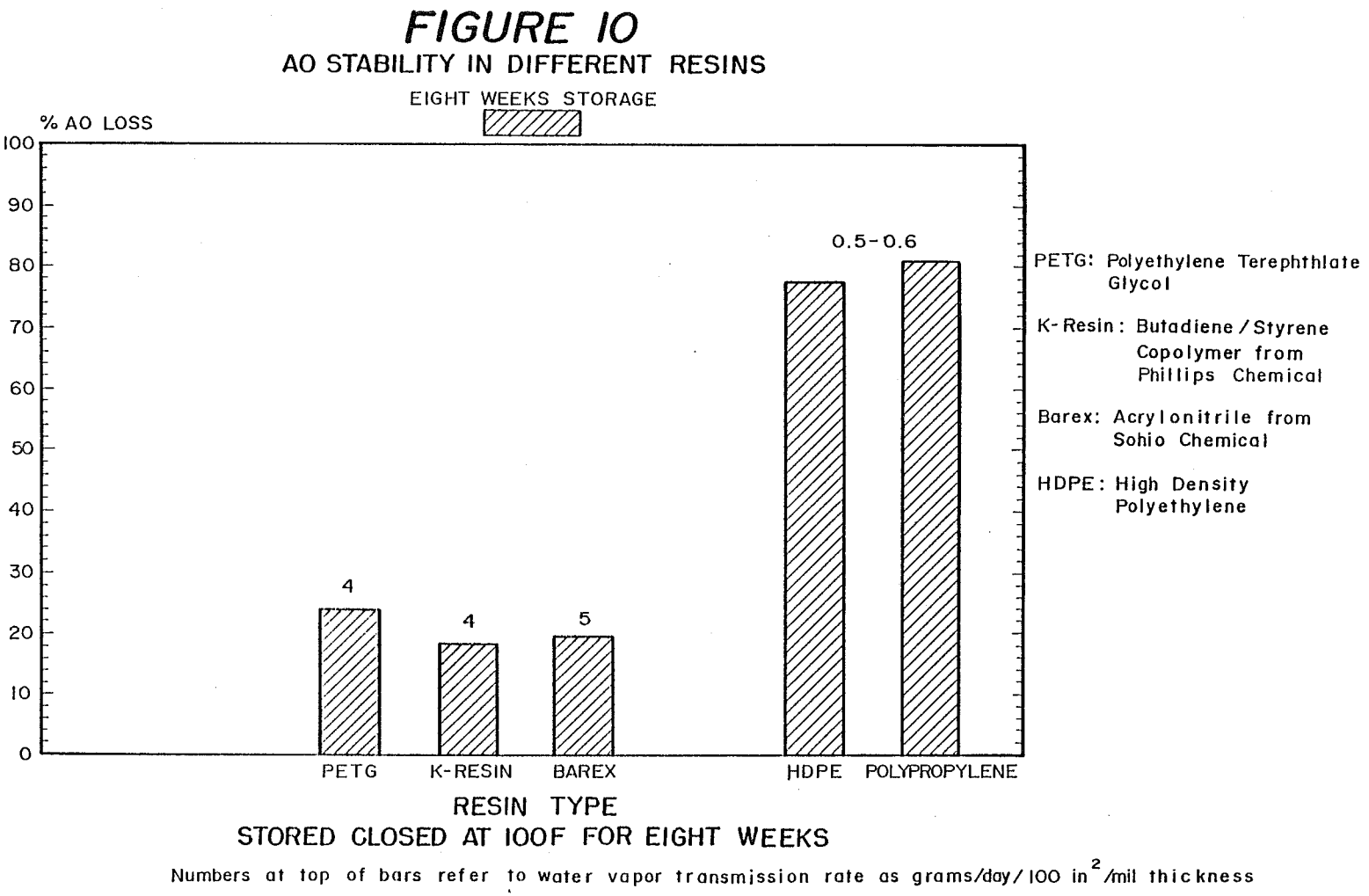
FIG. 10 shows stabilities of an oxidant contained in bottles made of different plastics stored at 1000° F.

4 oz. bottles were filled to 90% of the volume with the above compositions. These bottles were stored at 100° F. for eight weeks. Thereafter the products were assayed to determine amount of active oxygen as % A.O. remaining. As demonstrated in FIG. 10, the heteropolymeric plastics resulted in much better bleach stability at high temperature. This indicates much better long term stability when these materials are used.

In an odor test, Example II, the odor resulting from use of the preferred heteropolymer, butadiene/styrene, was much better than that resulting from the use of a polyvinyl chloride plastic in Example III.

EXAMPLE II

Samples of the oxidant bleach were stored in vented butadiene/styrene bottles with fragrancing means at 100° F. for eight weeks and evaluated for fragrance intensity, character change and base coverage (i.e. identifiable as original fragrance).

In the 100° F. samples, the samples were recognizable as containing original fragrance and were not offensive.

EXAMPLE III

A bottle composed of polyvinyl chloride which included a fragrancing means was substituted. At 100° F., the smell was unpleasant.

Although the above description and drawings and the claims which follow hereto describe a container useful for housing an oxidant bleach and is provided with a fragrancing means, in fact, this invention is not limited thereto and obvious equivalents and alternative embodiments consistent with the scope and content of this application are included herein.

We claim:

1. A transparent, durable container comprising a plastic bottle and a closure therefor and a granular peracid bleach disposed within said bottle, said bleach containing residual amounts of moisture, said bottle being constructed from a heteropolymer having a water vapor transmission rate of at least about 2 g/day/100 in.$^2$/mil. thickness.

2. The invention of claim 1 wherein said peracid is a diperacid selected from

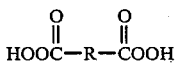

wherein R is a linear alkyl chain of about 6 to 12 carbon atoms in the chain.

3. The invention of claim 2 where in said heteropolymer comprises a polymer and/or copolymer selected from the group consisting essentially of polyvinyl chloride, butadiene/styrene, acrylonitrile and polyethylene terephthalate glycol.

4. The invention of claim 3 in which said polymer is a butadiene/styrene copolymer.

5. The invention of claim 1 further comprising venting means for venting the interior of the container to the atmosphere.

6. The invention of claim 5 wherein said bottle includes a finish and said venting means comprises at least one aperture provided in said finish.

7. The invention of claim 5 wherein said bottle includes a finish, and a close adapted to close said finish in rotating engagement therewith, and said venting means includes a gas passage provided between said closure and said finish.

8. A container comprising a plastic bottle and a closure therefor, said container containing therein a free-flowing granular peracid oxidant bleach composition which has residual amounts of moisture, said container including fragrancing means for fragrancing the interior of the container, and barrier means isolating the fragrancing means from contact by said bleach contained within the container and for allowing the fragrancing means to communicate with the container interior; wherein said plastic has a water vapor transmission rate of at least about 2 g/day/100 in.$^2$/mil. thickness.

9. The container of claim 1 in which the fragrancing means comprises a fragrance incorporated in a nonrigid organic polymer.

10. The container of claim 9 in which said organic polymer of the fragrancing means is selected from the group of water-miscible, water-dispersible and hydrophobic polymers.

11. The container of claim 10 in which the polymer of the fragrancing means is a hydrophobic polymer.

12. The container of claim 11 in which the polymer is a copolymer of ethylene and vinyl acetate.

13. The container of claim 12 in which said closure houses said fragrancing means and said barrier means.

14. The container of claim 13 in which said barrier means further comprises a plurality of apertures which allows ingress of the fragrance to the unfilled portion of the container but does not allow any of the granular bleach composition to contact the fragrancing means.

15. The container of claim 14 in which said apertures have an average bore size smaller than the average particle size of said bleach composition.

16. The container of claim 15 wherein said apertures have an average bore size of about 0.25 mm to about 4 mm.

17. The container of claim 16 wherein the number of apertures/area is in the range of about 0.3 apertures/cm$^2$ to about 16 apertures cm$^2$.

18. The container of claim 1 in which the bottle is constructed from a hard, transparent, durable plastic which is composed of a heteropolymer which does not contain a halogen atom other than fluorine.

19. The container of claim 18 wherein said plastic comprises a polymer and/or copolymer selected from the group consisting essentially of butadiene/styrene, acrylonitrile and polyethylene terephthalate glycol.

20. The container of claim 19 in which said polymer is a butadiene/styrene copolymer.

21. The container of claim 1 further comprising venting means for venting the interior of the container to atmosphere.

22. The container of claim 21 wherein the bottle includes a finish and said venting means comprises at least one aperture in the finish.

23. The container of claim 21 in which the venting means comprises means in said closure for preventing complete sealing of the container when said bottle closure is closed on said bottle.

24. A container comprising a transparent bottle with at least one chamber containing a dry, granular peracid bleach composition which contains residual amounts of moisture, said composition being in a portion of said chamber, the remainder of the chamber defining the headspace thereof, the container further comprising a closure which combines with a finish of said bottle, said closure including a well, fragrancing means contained within said well, barrier means located between said fragrancing means and the skirt of said closure and a venting means above said barrier means to allow gaseous communication between the interior of the container and the external environment when the closure is combined with said bottle; wherein said bottle is constructed of a plastic having a water vapor transmission rate of at least about 2 g/day/100 in$^2$ mil. thickness.

25. The container of claim 24 wherein said peracid is a diperacid selected from

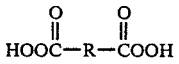

wherein R is a linear alkyl chain of about 6 to 12 carbon atoms in the chain.

26. The container of claim 25 wherein said bottle is constructed of a plastic which comprises a polymer and/or copolymer selected from the group consisting essentially of butadiene/styrene, acrylonitrile and polyethylene terephthalate glycol.

27. The container of claim 26 in which said copolymer is a butadiene/styrene copolymer.

28. The container of claim 27 further comprising venting means for venting the interior of the container to the atmosphere.

29. The container of claim 28 in which said venting means comprises means such that when the closure is combined with the finish of said bottle, an incomplete seal forms which allows for gaseous interchange.

30. A transparent, durable container comprising a plastic bottle and a closure therefor and a granular peracid bleach disposed within said bottle, said bleach containing residual amounts of moisture, said bottle being constructed from a plastic having a water vapor transmission rate of at least about 2 g/day/100 in$^2$/mil. thickness so as to avoid decomposition of the granular peracid contained therein by said residual amounts of moisture, said plastic being selected from the group consisting of: butadiene - styrene, polyvinyl chloride, acrylonitrile, and polyethylene terephthalate glycol.

* * * * *